US008398268B2

(12) United States Patent
Elberbaum et al.

(10) Patent No.: US 8,398,268 B2
(45) Date of Patent: Mar. 19, 2013

(54) METHOD AND APPARATUS FOR ATTACHING POLYHEDRON COVER TO AN ILLUMINATOR AND OPERATING IT

(76) Inventors: David Elberbaum, Tokyo (JP); Yeynat Elberbaum, Zihron Yaacov (IL)

( * ) Notice: Subject to any disclaimer, the term of this patent is extended or adjusted under 35 U.S.C. 154(b) by 839 days.

(21) Appl. No.: 12/571,733

(22) Filed: Oct. 1, 2009

(65) Prior Publication Data

US 2011/0080114 A1 Apr. 7, 2011

(51) Int. Cl.
*F21V 21/00* (2006.01)
*F21V 21/26* (2006.01)

(52) U.S. Cl. ..... 362/249.16; 362/271

(58) Field of Classification Search ..... 362/249.16, 362/183, 184, 249.01, 249.02, 249.05, 227, 362/269, 271, 273, 565, 566; 315/185 R, 315/185 S See application file for complete search history.

(56) References Cited

U.S. PATENT DOCUMENTS

| | | | | |
|---|---|---|---|---|
| 5,921,668 | A * | 7/1999 | Bayer | 362/404 |
| 7,267,463 | B2 * | 9/2007 | Bayer et al. | 362/441 |
| 7,347,594 | B2 * | 3/2008 | Bayer et al. | 362/433 |
| 2009/0147511 | A1 * | 6/2009 | Simon | 362/235 |

* cited by examiner

*Primary Examiner* — Minh D A

(74) *Attorney, Agent, or Firm* — Katten Muchin Rosenman LLP

(57) ABSTRACT

An illuminator base includes slots to enclose the flaps, locks to attach the flaps and a rotating actuator that is used as a rotating base for the illuminator to enable the rotation of the cover around a stand or a support to review the imprinted motifs or menus around the cover. The illuminator base further includes at least one switching device and the actuator includes activator for said switching device and the illuminator is actuated by rotating and pushing or pulling the cover.

23 Claims, 8 Drawing Sheets

FIG. 2A
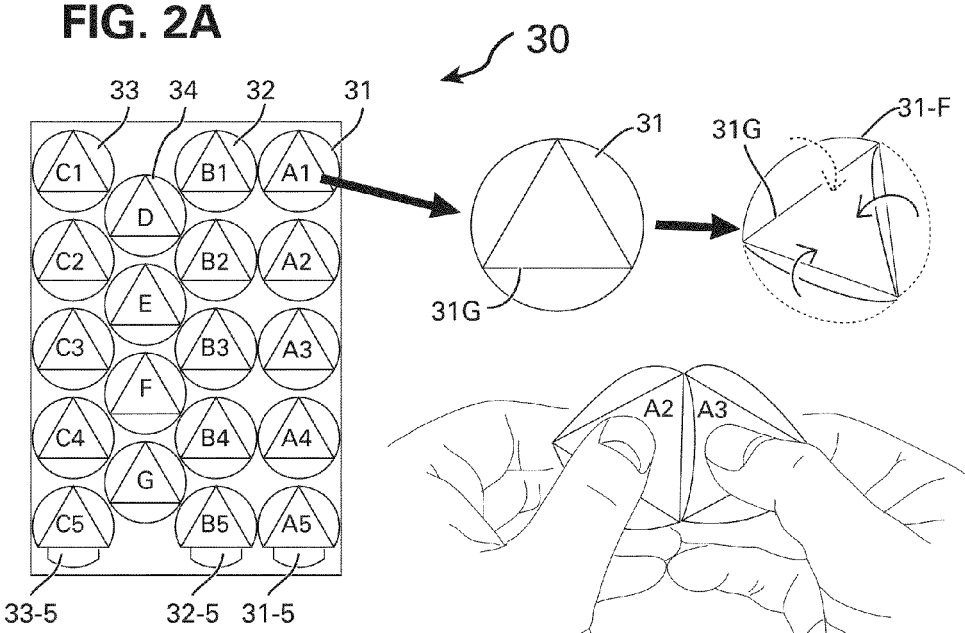
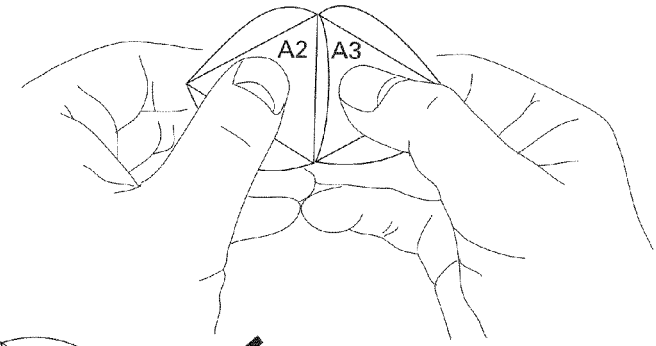
FIG. 2B
FIG. 2C
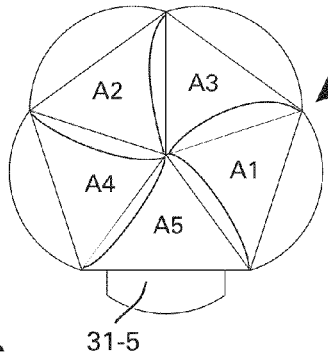
FIG. 2D
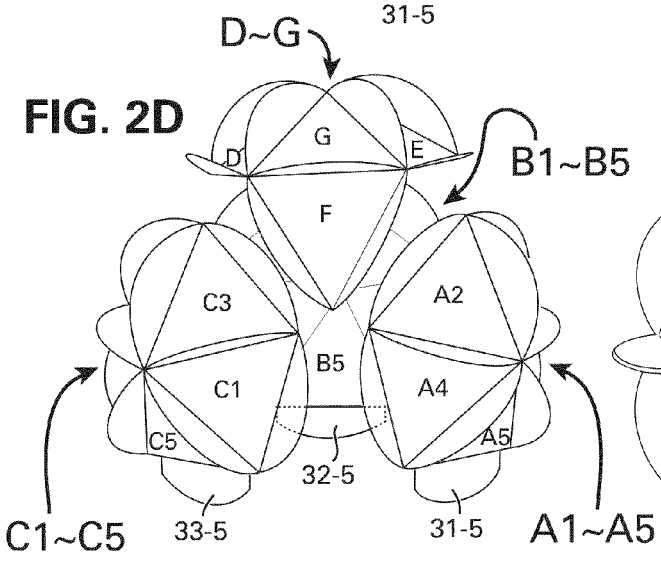
FIG. 2E
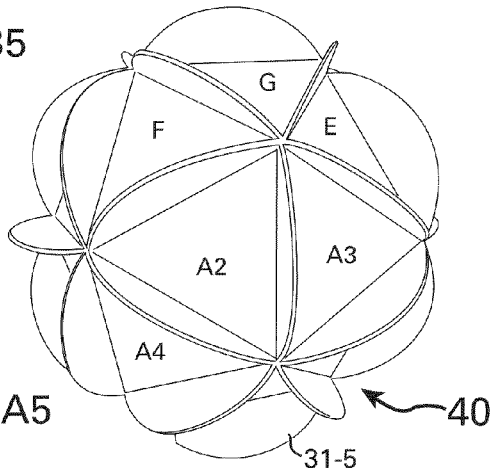

METHOD AND APPARATUS FOR ATTACHING POLYHEDRON COVER TO AN ILLUMINATOR AND OPERATING IT

BACKGROUND OF THE INVENTION

1. Field of Invention

This invention relates to illuminators, light fixtures and other decorating light devices including self assembling or do it yourself light decorations.

2. Description of the Prior Art

Light decorating devices including candleholders such as used in dining rooms or restaurants are mounted on walls, placed on shelves and tables and are attached to electrical cords that are inconvenient and not fit for portable decorating purposes, particularly for decorating a dining table. Similar are candleholders used in dining rooms and restaurants, they are inconvenient, require daily cleaning and care while lighting and handling.

Other well known decorative illuminators using small light bulbs or LEDs for simulating candlelight and/or with different colors and tint use batteries or rechargeable batteries and are convenient to users, however, such decorating light are available in given designs and shapes and are not always available in a design or shape that matches the surround and the interiors and/or are not fit for use in a given environment.

Further, such decorative LED illuminators are operated via select keys or buttons that are embedded into or under the light fixtures, and to switch or change the light color or program, the user has to pickup the fixture and touch the operating buttons or keys, which is not user friendly action.

SUMMARY OF THE INVENTION

It is an object of the present invention to provide a method and apparatus for self decorating and assembling light fixture covers and for switching the light on or off and/or changing the light color and/or for selecting light programs by rotating and/or twisting and/or otherwise touching the decorative light fixture cover.

The present invention is achieved by the use of an illuminator unit that incorporates batteries or rechargeable batteries, the light control circuit and the illuminating LEDs or light bulbs. The illuminator unit can be attached to variety of stands, wall mounts, ceiling mounts or other supports including pendant hang-on cords or decorative chains, and be covered by a pre punched or self cut cover pieces that are self decorated and assembled to form a light fixture cover, such as forming a self decorated polyhedron cover.

Another objects of the present invention is to provide the core unit with a remote control circuit such as IR or wireless control, which enables the remote switching or changing the light programs of one or a plurality of such light fixtures, in a given dining room, a restaurant or other establishment for changing the light programs or color that fit a given environment or for changing the environment at will.

The self designed and assembled polyhedron cover, such as icosahedron cover, can be an imprinted and pre-designed plastic sheet circles, pre-punched and/or perforated and processed onto printable size, such as a standard paper size selected from the well known ISO sizes A4, A3 or B4 or the US size 8.5×11 or any other standard sizes that can be fed to and printed by a printer, such as ink jet printer or laser printer, used with PCs. The PC can be installed with a custom program for enabling the printing of the pre punched and/or perforated plastic sheet with programmed designs or with self designed motives, logos and/or any other printed images or characters, including information such as menus and prices in restaurants, drinks in bars and/or commercials such as offers for services and etc, or directing visitors in establishment, such as galleries or museums. Similarly the self designed or pre-designed motifs can be printed in multi color using industrial printers, silk screen printers and other conventionally available printers and methods.

The self designed or prefabricated cover, assembled from a pre punched and/or precut, furrowed and/or perforated pieces, or by a self cut imprinted plastic or paper sheet, includes folded flaps that are inserted into notches or slots provided in the base of the illuminator unit, with the slots having sizes that fit the sizes of a precut flaps or portion of the circles or other shapes at the bottom of the assembled cover. The base of the illuminator uses locks to hold the cover tight to the base, wherein said locks can be tighten into place using fasteners such as screws or self locking hooks that tightly attach the cover to the illuminator's base. The tight mechanical attachment binding the cover to the base enables the engaging of the cover for operating the illuminator, such as switching the lights on and off and/or changing its illumination programs and/or the light color or tint at will.

The another object of this invention is therefore the controlling of the lighting by gently rotating, twisting, pushing or pulling the illuminator cover itself, and thereby activating or actuating the illumination control circuit. For this purpose the illuminator of this invention includes an actuator and a switch or other devices, such as photo switch with, optical interrupters or magnets with hall sensors mounted in the base and on the actuator, in and/or about a center portion of the base. The actuator is attached to a support or a stand, such as a tabletop stand, rotating around its center and/or is spring pushed into place, allowing the illuminator to be pushed side way and/or up or down, for activating or actuating a switch, tact switch and/or magnets and/or hall sensors and other devices that can be actuated by movement. Similar actuation is achieved by remote control signals, motion detector or sound.

BRIEF DESCRIPTION OF THE DRAWINGS

The foregoing and other objects and features of the present invention will become apparent from the following description of preferred embodiments of the invention with reference to the accompanying drawings, in which:

FIGS. 2A~2E are perspective views of the process for forming and assembling the icosahedron ball cover of the preferred embodiment of the present invention.

DETAILED DESCRIPTION OF THE PREFERRED EMBODIMENT

Figure 1A:
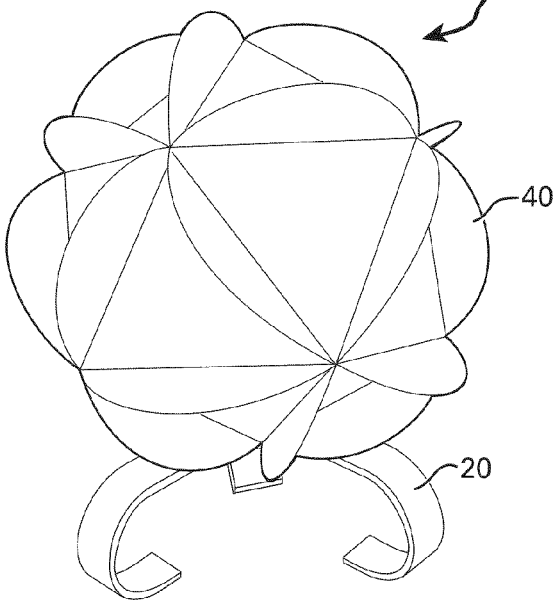
FIGS. 1A, 1B and 1C are perspective views showing a blank decorative cover and an imprinted decorative cover of the illuminators of preferred embodiment of the invention, including a common printer for printing onto a precut and furrowed sheet of the decorative cover.
Figure 1B:
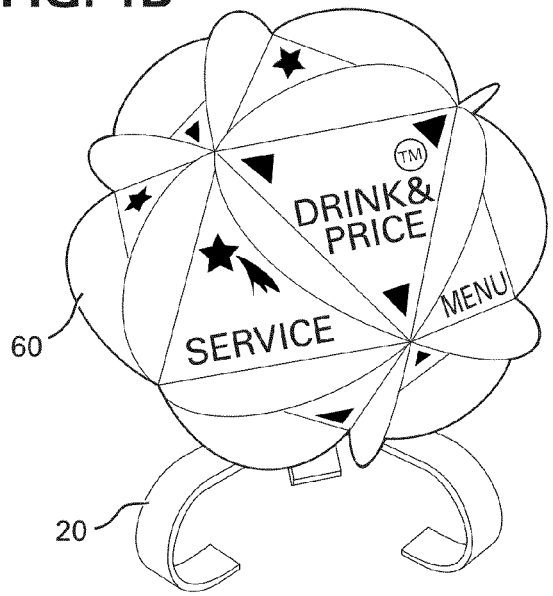

FIG. 1A shows an illuminator assembly 1 comprising a decorative semi transparent cover in a form of a well known icosahedron ball like structure 40 mounted on a table or shelf support or stand 20, made of folded metal or other solid material. FIG. 1B shows a similar decorative illuminator assembly, however the decorative cover 60 is imprinted with motifs, menus, prices and services, enabling the use of the illuminator for promoting sales, informing customers of services, sales items, special offering and many other motifs in multi colors, such as for a happy birthday party to a guest in hotels or restaurants and the like.

Figure 1C:
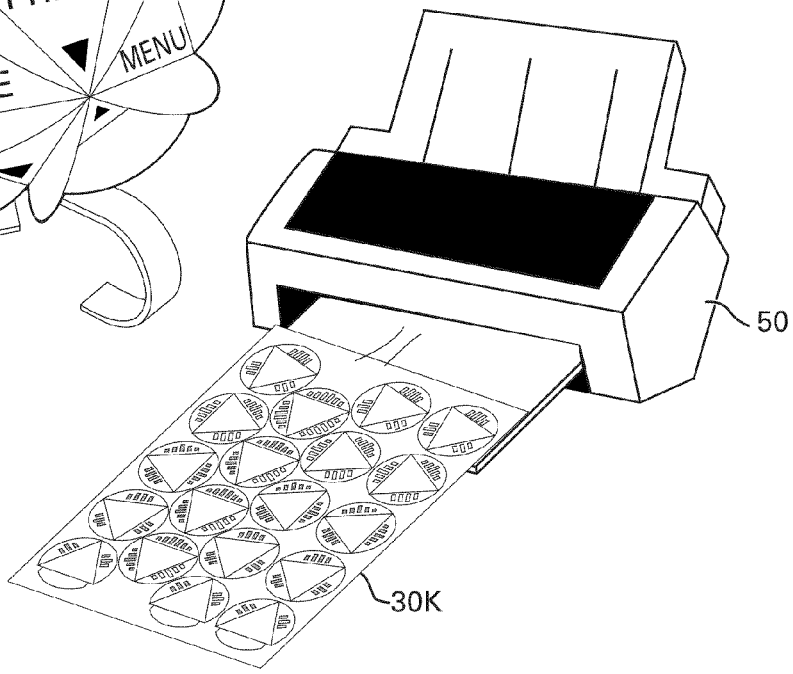

FIG. 1C shows a well known printer 50 such a ink jet or laser printer used with PCs and a precut plastic sheet 30K that is explained later, and which includes all the cut pieces, aligned such to enable printing of the decorative ball in one sheet. The sheet shown is of a standard ISO size known as A4, however any other size such as the US standard 8.5×11" or ISO size B4 or A3 or any other sizes can be used instead. The shown printer 50 is an example only and any printing method, such as silk screen and industrial printing can be used.

FIG. 2A shows the precut sheet 30 comprising 19 circles 31, 32, 33 and 34 that form an incomplete icosahedron ball 40 shown assembled in FIG. 2E. The icosahedron is a well known geometrical structure using twenty triangles similar to the shown nineteen triangles A1~A5, B1~B5, C1~C5 and D~G.

Figure 6A:
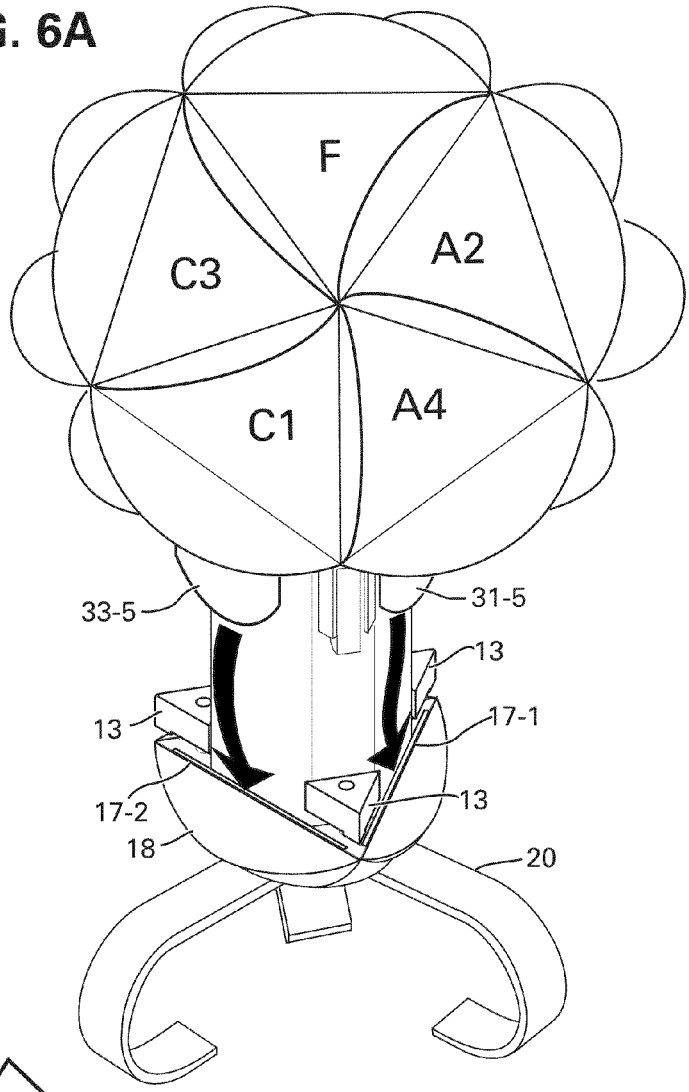
FIGS. 6A, 6B and 6C are perspective views showing the attaching and the locking of the assembled icosahedron cover to the base of the illuminator unit of the preferred embodiment of the present invention.
Figure 9A:
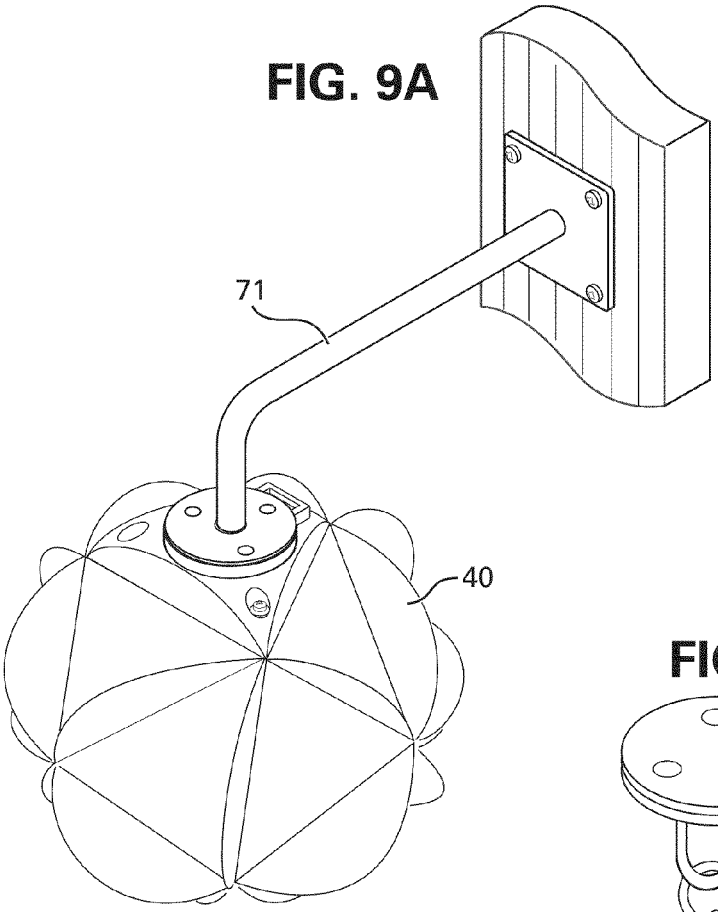
FIGS. 9A, 9B and 9C are perspective views of the ceiling and wall decorative mountings and supports for the illuminators of the preferred embodiment of the present invention.
Figure 9B:
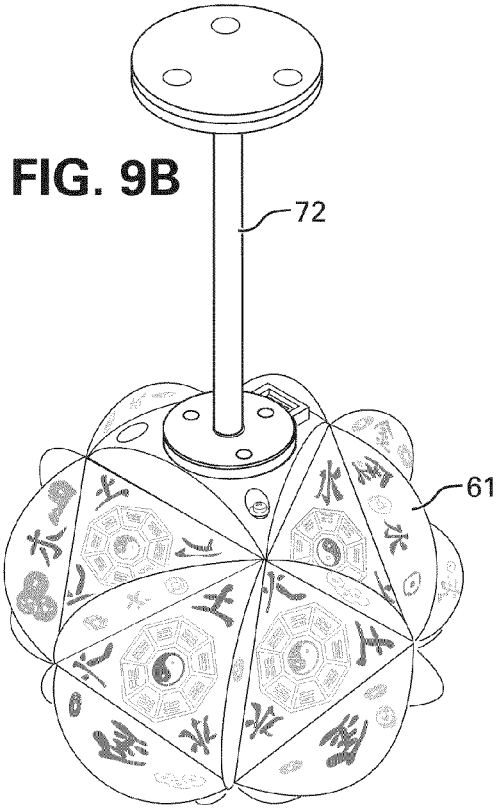
Figure 9C:
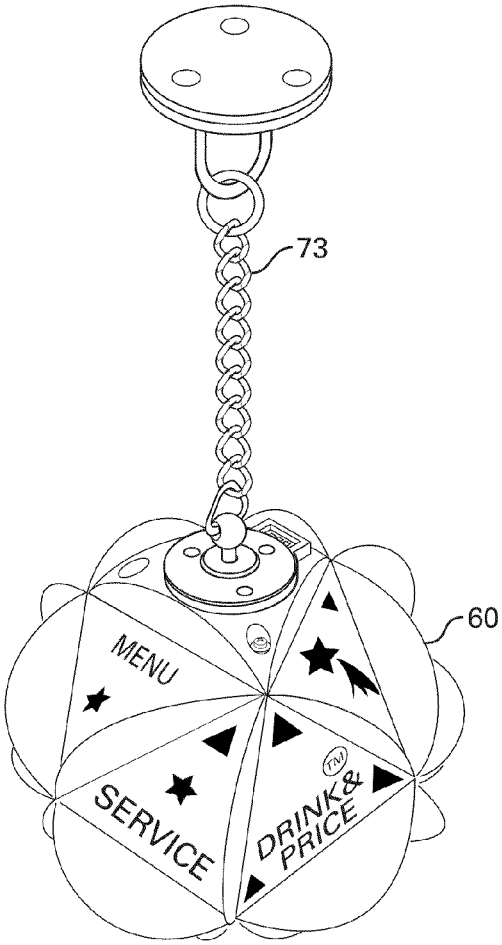

The icosahedron structure of the present invention is made complete by introducing a triangle base 18 at the bottom of the icosahedorn ball as shown in FIG. 6A, or on top when the illuminator is for mounting upside down as shown in FIGS. 9A, 9B and 9C.

Each of the three assembled circles A1~5, B1~5 and C1~5 shown in FIG. 2D include a curved flap 31-5, 32-5 and 33-5 clipped at both sides, for using the clipped flaps as the attaching flaps or attachment flaps to the illuminator base, this will be explained later. All of the nineteen circles shown are bended or folded around the triangle lines 31G as illustrated by the folded circle 31-F shown in FIG. 2A.

Figure 6B:
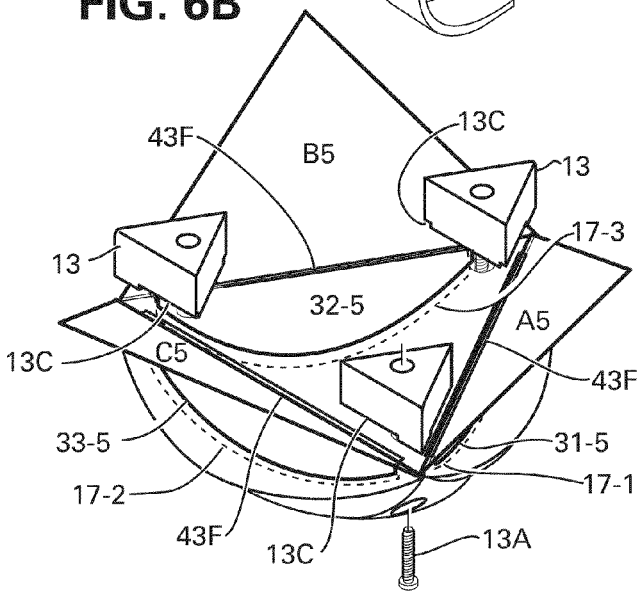

The folded flaps are bonded to each other using pre applied bond or by self applying bond onto one or both adjoining flaps that are bonded together, such as A2 and A3 shown in FIG. 2B. To assemble the entire icosahedron ball structure it is preferred to assemble three sets of five triangles each, such as A1~A5 set, B1~B5 set and C1~C5 set. A bonded and assembled group A1~A5 of five triangles is shown in FIG. 2C and the three assembled group of five A1~A5, B1~B5 and C1~C5 are shown in FIG. 2D. The three assembly of five triangles are all shown with their clipped or attachment flaps 31-5, 32-5 and 33-5 at the bottom, joint together. The three clipped flaps will be used to attach the incomplete assembled icosahedron ball structure with only 19 triangles to the base of the illuminator unit as shown in FIGS. 6A and 6B.

The four remaining D, E, F and G triangles 34 are bonded as shown in FIG. 2D to the three assemblies of the fives A1~A5, B1~B5 and C1~C5 assemblies to complete the assembly of the icosahedron ball 40 with only 19 triangles shown in FIG. 2E. As explained the icosahedron structure excludes one triangle, offering instead an hollow triangle surface surrounded by the clipped or the attachment flaps 31-5, 32-5 and 33-5. This hollow triangle surface is used for inserting the illuminator unit 25 into the decorative cover 40 or 60 shown in FIG. 1B The icosahedron structure is the preferred structure of the embodiment of the present invention, however, other well known polyhedron structures can be used. The dodecahedron (12 pentagons) example shown in FIGS. 3C and 3D and the octahedron (8 triangles) shown in FIGS. 3E and 3F are similarly structured to include clipped or attachment flaps 37 shown in FIGS. 3C and 3D and the clipped and truncated flaps 39 shown in FIGS. 3E and 3F. The clipped and/or the clipped and truncated flaps can be used to attach the five clipped or attachment flaps 37 to an illuminator base having a base with five corresponding slots (not shown), while the four truncated and clipped flaps 39 can be attached to an illuminator base having four corresponding slots (not shown).

The eleven out of the twelve pentagon shape sheets used for the incomplete dodecahedron of the sheet 36 are surrounded by flaps for bonding the pentagons together to assemble a dodecahedron ball, excluding the shaped and clipped flaps 37 for attaching the dodecahedron ball assembly to an illuminator unit (not shown).

The same applies to the eight triangles of the sheet 38 forming the octahedron dual pyramid structure, with the lower, reversed pyramid is truncated and clipped for providing the four flaps 39 to be used for attaching the octahedron assembly to a base of an illuminator having the four corresponding slots (not shown). Regardless, it becomes clear from the illustrations in FIG. 3C and FIG. 3E that the sheets 36 and 38 can be printed with designs or imprinted with information, sales menus and in any color and/or motifs for providing self designed or pre designed decorative cover to an illuminator unit, similar to the illuminator unit 25 shown in FIGS. 4A and 4B having triangle shaped base, by having square shape base or pentagon shape base.

Figure 3A:
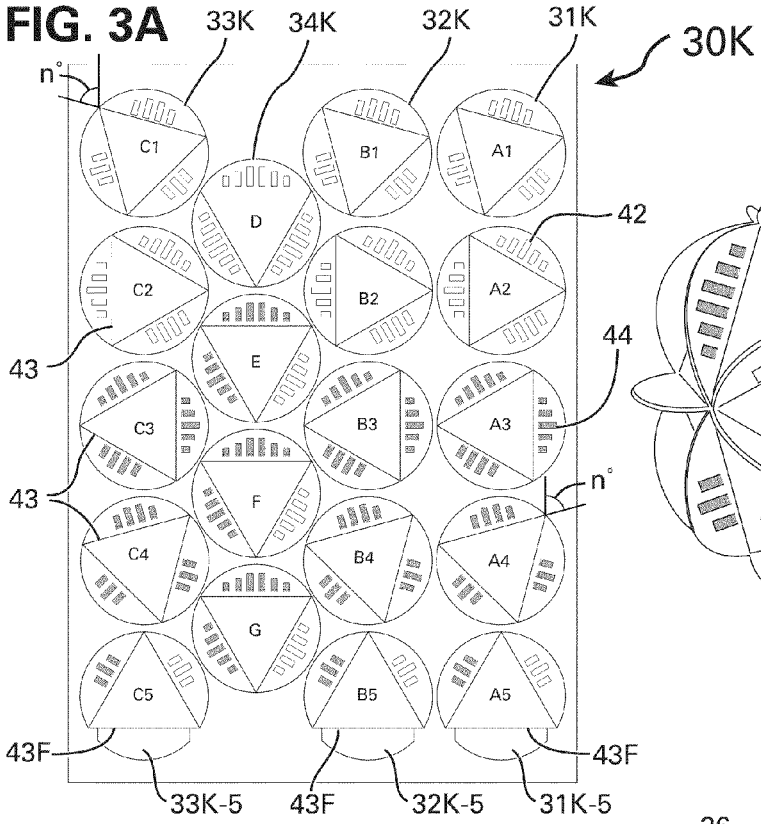
FIGS. 3A and 3B are perspective views showing the keyed circles for the icosahedron, for preventing the misassembling of the illuminator cover of the preferred embodiment of the present invention.

While the triangles of the octahedron and the pentagons of the dodecahedron of the examples can be logically aligned and imprinted in a straight lines, the same cannot be easily configured for the icosahedron circles of the sheet 30K shown in FIG. 3A. The reason is that the blank circles can be attached freely in any given orientation or direction, except of course the flaps 31-5, 32-5 and 33-5, which must be assembled together at the bottom or top of the icosahedron ball structure at the conclusion of assembling of the recited three five triangle assemblies A1~A5, B1~B5 and C1~C5. The bended circles 31-F can therefore cause for misplacement and error bonding and error in orienting the angles of the individual triangles of the icosahedron ball structure.

The precut keyed flaps of the circles 31K, 32K, 33K and 34K include keys that are coded by the number and the sizes of cutouts 42 that match the number and sizes of a protruding half cut keys 44 shown in FIG. 3A. The keyed cutouts are adjacent the furrowed triangle lines of the curved folded flaps. The shown keys are coded by 3, 4 and 5 cutouts 42 corresponding to the 3, 4 and 5 half cut protruding convexes 43. The three different cutouts and the convexes in three different lengths provide sufficient key code combinations for the 19 circles without error. Further, the pre applied bond is limited to pre applying of bond only onto the flaps with cutouts, thereby providing a comprehensive error free assembling of the circles in a precise accurate process.

Moreover the precut circles 31K~34K and the indentation of the furrows 43 formed by sheeting cutters, shown also in FIG. 2A as a furrow 31G, are precisely oriented and set into angles n° shown in FIG. 3A, such that the self designing and printing of motifs and texts need not be re adjusted. The circled triangles are laid out in a calculated angles n° that provide the resulting of the printing of text and motifs in a straight horizontal lines, such that the assembled icosahedron ball will be readable straight around, as shown in FIG. 1B.

Figure 4A:
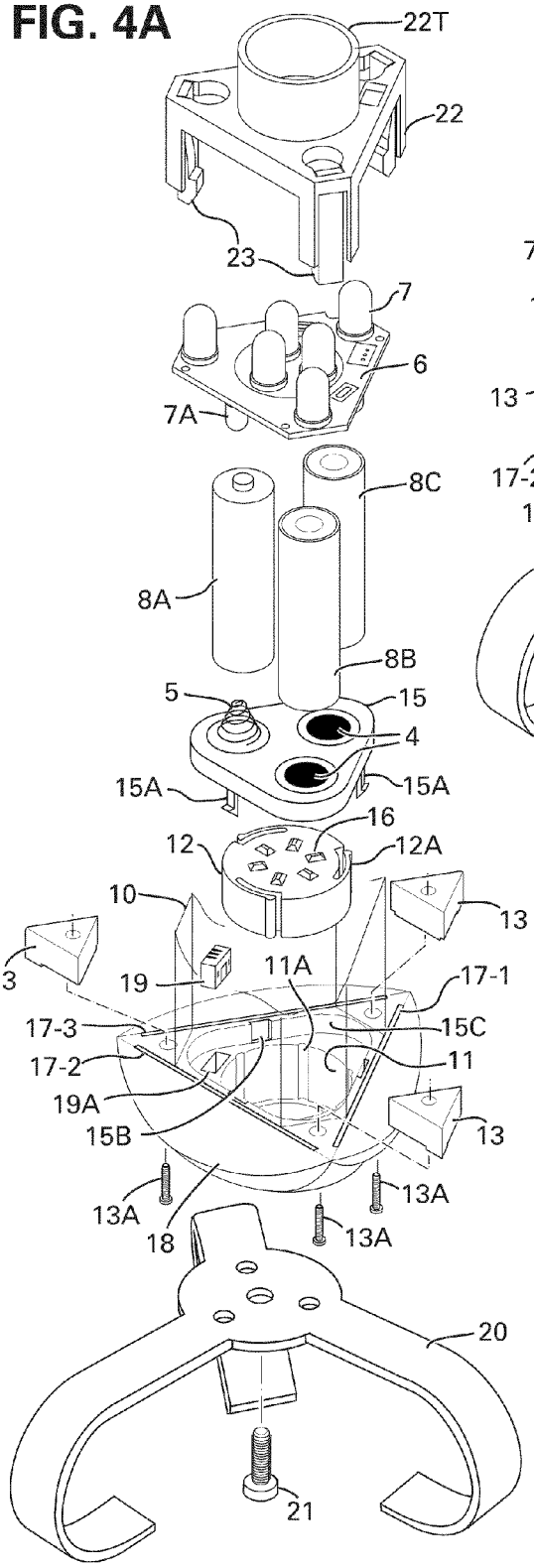
FIGS. 4A, 4B and 4C are exploded and assembled views of the illuminator unit, its base with a table or shelf support of the preferred embodiment of the present invention.
Figure 4B:
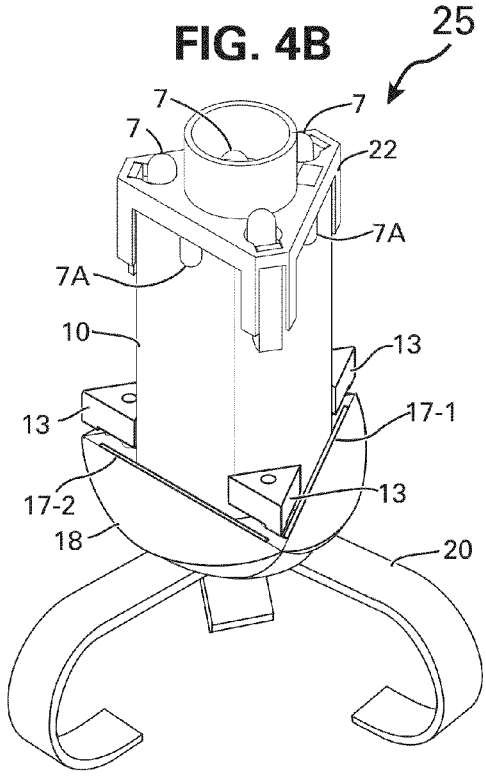
Figure 6C:
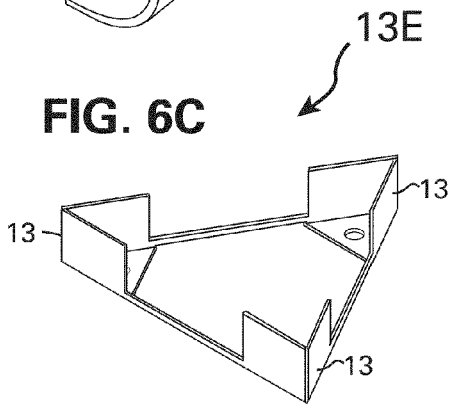

FIG. 4B shows the assembled illuminator unit 25 with its base attached to a tabletop or shelf stand with legs 20. The illuminator unit or main unit comprises a body 10, a base 18 and top cover 22 which houses and holds the printed circuit board 6 including a plurality of LEDs 7 and 7A. The base 18 is provided with three slots or notches 17-1, 17-2 and 17-3 for receiving and enclosing the flaps 31K-5, 32K-5 and 33K-5 shown in FIG. 3A and three locks 13 for locking the decorative icosahedron ball cover to the base 18 as shown in FIGS. 6A, 6B and 6C and will be explained later. The three locks 13 and the combined lock 13E are secured and fastened by the three screws 13A shown in FIGS. 4A and 6B, but can be secured by other fastener and/or locking hooks.

Figure 5A:
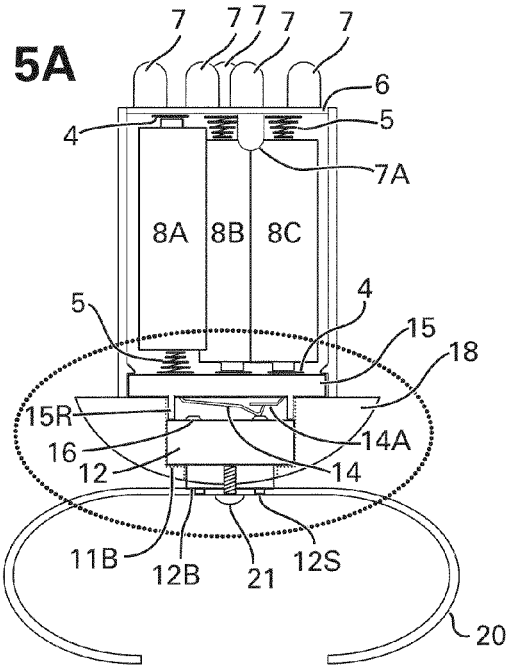
FIGS. 5A, 5B, 5C and 5D are sectional views of the switching and control structure variations inside the base of the illuminator unit shown in FIGS. 4A and 4B.

The exploded view of the illuminator unit 25 is shown in FIG. 4A. The shown base 18 is a hollow base comprising round cavity 11 with cutouts 11A for housing a rotating actuator 12 that includes three springy arm guides 12A to provide rotation clicking steps throughout the rotation movement of the actuator 12. As shown in FIG. 5A the actuator 12 is supported at its bottom by the formed housing 11B and held in place by the battery base 15. The battery base 15 includes at its bottom surface a leaf switch 14 and a contact 14A, wherein the leaf switch 14 is pushed upwards to switch on the leaf switch circuit via the contact 14A by one of the six projected cams or activators 16, shown on the upper surface of the actuator 12, when the actuator is rotated. It is equally possible to have notches on the upper surface of actuator instead of the cams 16 to provide a reversed switching polarity, whereby the control circuit will be activated when the leaf switch circuit is open or switched off.

As will be explained later the illuminator can be operated by remote control signals such as IR or RF and/or operated by motion detection and/or by a surrounds sound and the rotating actuator cams 16 or notches including the switches and/or the use of photo interruptors with photo switches or the magnets with hall sensor that are discussed later may not be needed and not used for the illuminator operation, thereby the rotation of the polyhedron cover will not be needed for operating or for controlling the illuminator.

Yet the different menus, services, offers and other information imprinted on the polyhedron cover clearly shows the advantage of rotating the cover in order to view the printed information around the polyhedron. By this the actuator of the preferred embodiment clearly demonstrate the multiple advantages of the rotating actuator variations, including this simple solution for rotating the illuminator polyhedron cover.

Figure 4C:
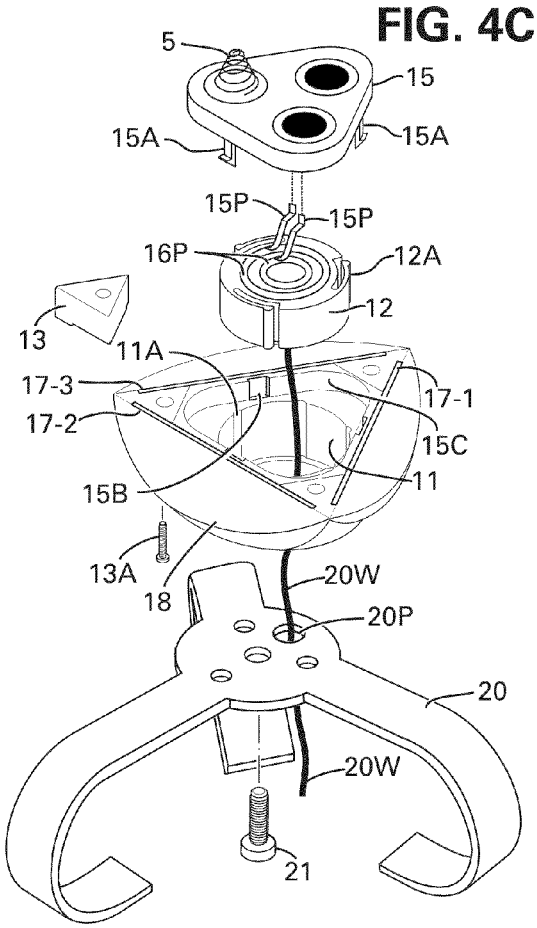

The rotating actuator 12 with its clicking mechanism comprising the springy arm guides 12A and the cutouts 11A of the round cavity 11 explained above offer a stop mechanism at each click, preventing free rotation without stop for the combined illuminator and its polyhedron cover. Further, with the cams 16 or the notches and the leaf switch 14 and the contact 14A are not used it is possible to use the rotating actuator for feeding power. This is achieved by the introduction of rotating contacts also known as slip rings, instead of the switch 14, the contact 14A and the cams 16, for connecting electric wire to feed power to the illuminator as shown in FIG. 4C. The upper surface of the actuator 12P comprises two slip rings 16P with the bottom surface of the battery base 15 includes two reciprocating springy contacts 15P for feeding the power to the control circuit 6 and/or for charging the battery. The slip rings 16P are connected to a power cable 20W that is fed through a cable access 20P in the support or the stand 20.

Instead of the cable passing through the stand 20 an electromagnetic induction coil structure (not shown) can be installed attached under stand 20. It should be clear that different power feed can be configured and implemented via the slip ring of the rotation actuator 12P. The term actuator in the following description and claims is used also for the actuator 12P for simplifying the terminology, even though the actuator 12P shown serve only to rotate the decorative polyhedron cover attached to the illuminator body and does not actuate the illuminator.

Figure 7:
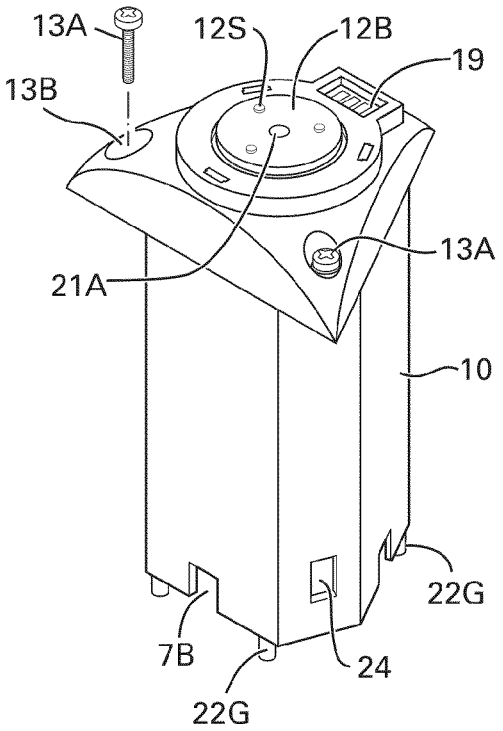
FIG. 7 is a perspective view of the body of the illuminator unit shown from its base side.

The cable feed 20P through the stand 20 is an additional hole provided for the cable passage along with the shown four holes used for the screw 21 and the pins 12S shown in FIG. 7. However it is of course possible for example to use the center hole 21A shown in FIG. 7 to be the cable passage and use three smaller screws (not shown) in place of the pins 12S for installing the stand 20. From the above explanation it becomes clear that the actuator 12P can become a rotating base for the illuminator body 25 combined with the polyhedron cover 40 or 60 for enabling to rotate the cover to view its printed content, it is similarly clear that the actuator 12P can be also used to feed power via its rotating ring or slip ring 16P and the slip ring contacts 15P.

The base 18 further provides a cavity 19A for housing the connector 19 that connects a battery charger to the rechargeable batteries 8A, 8B and 8C. The battery base 15 locks into position and retains the battery charger connector 19 and the actuator 12 in their respective cavities, 19A for the connector 19 and the round housing 11 for the actuator 12. The battery base is locked into its cavity 15C via three hooks 15A of the battery base 15 that slide into the three hook slots 15B (only one is shown in FIG. 4A).

The battery base supports the three batteries or rechargeable batteries 8A, 8B and 8C using a well known spring 5 and surface contacts 4 that are commonly used in battery holders and containers, with the opposite contact 4 and the springs 5 are mounted at the bottom side of the PCB (Printed Circuit Board) 6, shown in FIG. 5A.

The body 10 of the illuminator unit is structured to hold three standard AAA batteries but any number of batteries and their size, shape, capacity and type can be used instead. The batteries can be regular non-rechargeable batteries, or rechargeable batteries. Instead of the shown connector 19 for recharging rechargeable batteries, a winding of a coil around a magnetic core can be used to recharge the batteries by a well known electromagnetic induction. There are many well known options for battery charging and any of the well known charging method can be used. The charging via the connector 19 shown in FIG. 4A is only an example of the preferred embodiment of the present invention.

The PCB assembly 6 is mounted onto the top holder 22 that locks the PCB 6 and the top holder to the illuminator body 10 via the three hooks 23 into three hook receivers or cutouts 24, only one is shown in FIG. 7. By this it becomes clear that the top cover 22 with the PCB that holds the batteries firmly onto the springs 5 and contact 4 can be easily removed for batteries replacement by releasing the three hooks 23 from the hook receivers or cutouts 24.

Figure 3B:
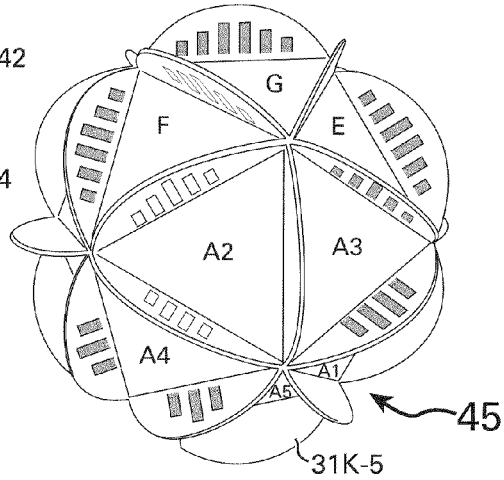
Figure 3C:
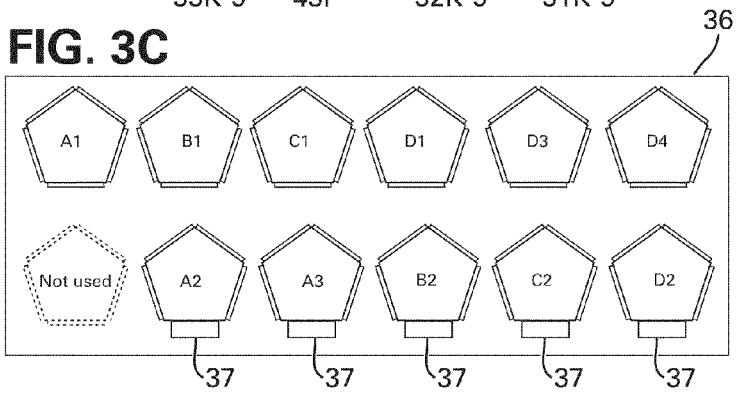
FIGS. 3C and 3D are perspective views of another polyhedron cover such as dodecahedron for a decorative illuminator similar to the preferred icosahedron of the preferred embodiment of the present invention.
Figure 3D:
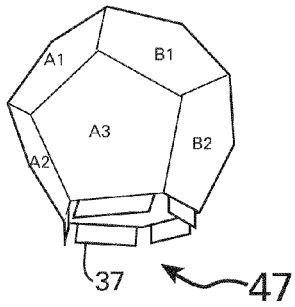
Figure 3E:
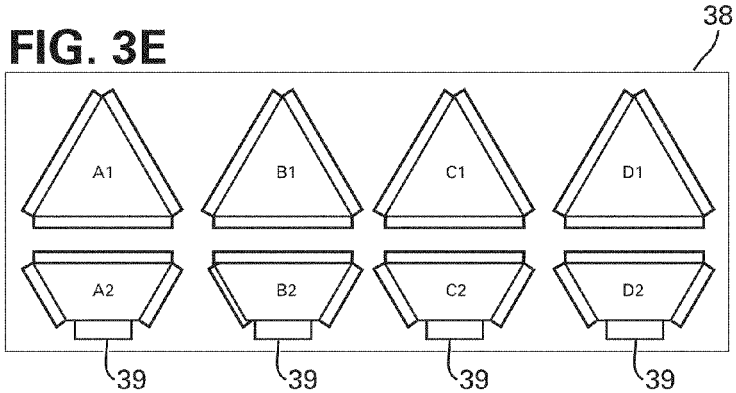
FIGS. 3E and 3F are perspective views of yet another polyhedron cover of a decorative illuminator such as octahedron.
Figure 3F:
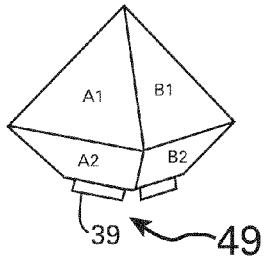

The top cover 22 shown in FIGS. 4A and 4B is designed such that its top surface 22T will support the inner surface of the top triangle F of the icosahedron cover shown in FIGS. 2E and 3B to improve upon the structural strength of the installed cover onto the illuminator, however even though it is not always needed, the top surface 22T can be designed differently for accommodating other polyhedron covers such as the shown dodecahedron of FIG. 3D, octahedron of FIG. 3F and/or such as hexahedron (a cube) and/or such as tetrahedron (a triangular pyramid) (not shown) and any other polyhedron structure.

Wires (not shown) are used for connecting the leaf switch 14 circuit and the battery charger connector 19 between the battery holder 15 and the PCB assembly 6. The wires are passing through a passage in the body 10 of the illuminator unit 25 (not shown) and are attached by a mini connector to the PCB assembly 6. When the batteries are replaced the mini connector (not shown) can be disconnected or the entire top holder 22 including the PCB 6 can be flipped to the side of the body 10 retained by the connecting wires (not shown) to allow for unobstructed replacement of the batteries. After the batteries are inserted the top holder 22 can be set back into place and relocked by its three hooks 23.

FIG. 5A is a side view of the illuminator unit, showing a simplified structure of the actuator 12, including the batteries 8A, 8B and 8C with the PCB assembly 6, its battery springs 5, contact 4 and the LEDs 7 and 7A placement. The base 18 retains the rotating actuator 12 inside its rounded housing 11 and its bottom support 11B. The bottom of the rotating actuator 12B is protruding through the bottom support opening 11B, about the base center, to enable the attachment of the stand 20 using a screw 21. The bottom 12B of the actuator 12 includes three protruding pins 12S, shown also in FIG. 7, to ensure that the rotating actuator 12 is firmly attached to the stand 20 and will not slip if the screw 21 is not tightly secured. Similarly the stand or the support can be installed by plurality of hooks and by any other common fasteners.

By this it becomes clear that the entire illuminator unit 25 is rotatable around its rotating actuator 12 that is attached or installed to the stand 20 or other support and placed on a table or other flat surfaces. To ensure no mechanical looseness the battery base 15 is provided with precise ring 15R that pressures the rotating actuator 12 equally and keep it tight in place. When the illuminator unit body 10 or base 18 are rotated, the activators or the projected cams 16 or notches (not shown) on top of the rotating actuator 12 will engage and push upward the leaf switch 14 to shorten the leaf switch circuit via the contact 14A, or release the contact and open the switch circuit, thereby generating a given command to the central processing unit that is explained later, for switching the illuminator on or off, or changing the LEDs color, or changing the lighting program and/or selecting other programs for the lighting sequences, brightness, timing including variations and combinations thereof.

Though the preferred embodiment of the present invention uses a mechanical cam 16 or a notch to activate the leaf switch 14 for generating a pulse signal to switch the illuminator on or off and/or for activating the illumination programs, the present invention includes non mechanical cam or notch for such activation. The preferred embodiment can use a magnetic hall sensor and a photo switch for generating actuating pulses, activated by a magnet and photo interrupter respectively. The term switching device in the following descriptions and claims refers to a switch, a leaf switch, push switch, pull switch, tact switch, micro switch, photo switch, hall sensor and combinations thereof. The term activator in the following description and claims refers to the cam 16, a notch, a magnet 16M and a photo interrupter 16L.

Figure 5B:
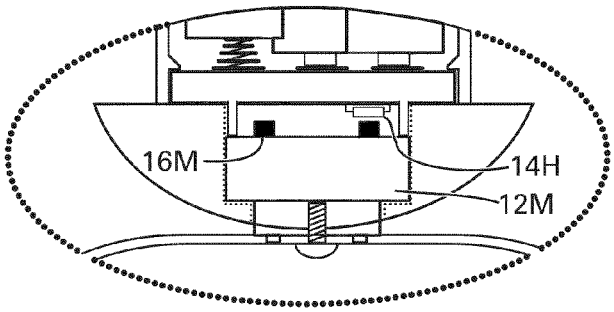
Figure 5C:
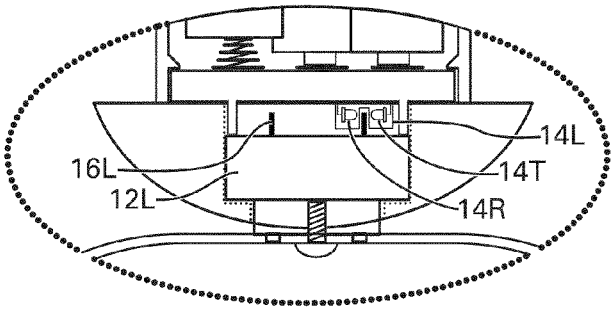

FIG. 5B shows that a magnet 16M mounted on the top surface of the rotating actuator 12M will actuate the hall sensor 14H mounted under the battery base 15 when the magnet 16M passes across the hall sensor 14H, generating a pulse to the control circuit. FIG. 5C shows another setup wherein the rotating actuator 12L comprises light interrupters 16 for interrupting or enabling a light path of a photo switch 14L, combining an LED 14T and a photo transistor or pin diode 14R, thereby offering yet another non mechanical trigger circuit to switch the illuminator on-off and/or for starting a sequence of illumination programs. The three explained methods to generate a trigger or actuating pulse shown in FIGS. 5A, 5B and 5C are set by rotating the illuminator body 25 around the rotating actuator 12, 12M and 12L respectively, with the rotating actuator being fixedly attached to the stand 20.

Figure 5D:
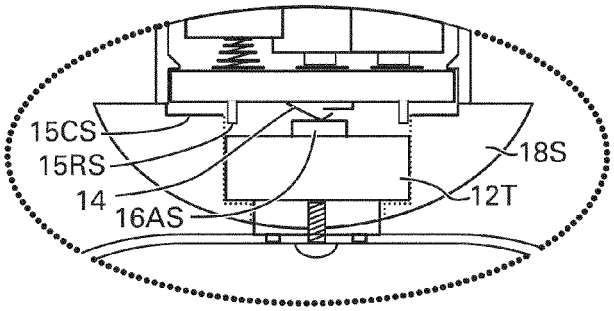

FIG. 5D shows an actuator structure that is activated by pushing the illuminator top cover 22 or the base 18 downwards and/or side ways. The cavity 15CS of the base 18S shown in FIG. 5D is a deeper cavity (or the battery base 15 is made thinner) for enabling down movement by the battery base inside the cavity 15CB. Similarly the surrounding ring 15RS that retains the actuator 12 is shorter in its length for the same reason, the enabling of down movement of the battery base 15. The shown mechanical switch 14S can be a well known tact switch or any push switch, or it could be a magnet or photo interrupter activated by pushing down the illuminator body and engaging the switch 14B by the protruding or projected surface 16S, or by introducing a light interrupter to a photo switch and/or by closing a gap between an hall sensor and a magnet. When using other actuating devices such as the photo switch and an interruptor or magnet and hall sensor shown in FIGS. 5B and 5C a spring (not shown) can be inserted between the battery base 15 and the rotating actuator 16S to ensure the return upward movement of the illuminator body.

It is similarly possible to add a spring to keep the battery base 15 pressed down at all time (not shown) and reverse the activator and the switching devices such that pulling up of the icosahedron cover 40 or the illuminator body 25, or pulling it down when the illuminator is mounted upside down as shown in FIGS. 9A~9C, will generate an actuating pulse.

The preferred embodiment of the present invention uses a single leaf switch or other well known switch such as push switch, tact switch or micro switch, however plurality of switches 14, hall sensors 14H and photo switches 14L and combinations thereof can be used. As will be explained later, such plurality of triggering switches and devices along with pre programmed activators including the actuating cams 16 and/or notches, and/or light interrupters 16L and/or magnets 16M can provide multiple control feed to the CPU 84 shown in FIG. 8 for enabling an advanced programs setting and for selecting illumination sequences, durations, colors, intensity, automation, variation, and combinations thereof, by rotating the illuminator body around the actuator 12 at a given or selected angle, measured for example by the number of clicking of the springy arm guides 12A referred above.

FIG. 6A shows the assembled icosahedron cover 40 or 60 shown in FIG. 1A and 1B that slides onto the body of the illuminator toward the base 18. The missing triangle at the bottom of the icosahedron cover fits the triangle body 10 of the illumination unit, the body 10 is shown in FIG. 7. The shown clipped attachment flaps 31-5 and 33-5 including the not shown clipped flap 32-5 are inserted into the slots 17-1, 17-2 and 17-3 shown in FIG. 6B. The three locks 13 provide guided positions for the triangle edges and locking support to tightly attach the folded furrows 31G of FIG. 2A and 43 of FIG. 3A.

Even though the locks 13 are shown in FIGS. 4A, 4B, 6A and 6B as three separate locks 13, the locks 13 can be a single combined lock 13E by connecting the three locks at the bottom line or side line, such as shown in FIG. 6C. The combined lock 13 can be fabricated from a sheet metal or by an injected plastic molding or by other materials and processes and be held and secured to the base 18 by the same screws 13A shown in FIG. 6B, or by other fasteners.

The cut edges of the clipped flaps can be sufficiently bended to be inserted into the slots, even though the locks 13 cover the end portions of the three slots 17-1, 17-2 and 17-3. If the icosahedron material is thicker and difficult to bend the screws 13A that hold the locks 13 in place can be released for pushing upwards the locks for enabling easier bend and insert of the attachment flaps into their respective slot.

FIG. 6B is a respective view of the three triangles A5, B5 and C5 from inside the icosahedron ball shown in FIG. 2D, with their respective attachment flaps 31-5, 32-5 and 33-5 inserted into and with the three slots 17-1, 17-3 and 17-2 respectively are shown enclosing the attachment flaps. The slots shown in dashed lines are constructed to fully enclose the clipped flaps with the bended furrowed lines 43F shown in FIG. 3A are aligned with the triangle lines of the base 18, which is the outer lines of the slots 17-1, 17-2 and 17-3. When the three screws 13A are fastened the cut edges 31C of the three locks 13 will be firmly pressured against the bended furrowed lines of the three flaps, attaching firmly the icosahedron ball structure to the base 18.

The locks 13 are shown as a solid triangle blocks, formed by plastic molding or metal die cast, however the three individual locks can be parts fabricated from a metal sheet, such as the three triangle corners of the lock 13E shown in FIG. 6C. Even not shown, it is simple to understand that there are many other ways to attach and lock the flaps to the slots, for example it is possible to use screws or other fasteners to tightly attach the inner walls of the slots, or otherwise apply pressure such that the flaps are tightly held in place.

FIG. 7 shows a reversed (upside down) view of the illuminator unit for better illustrating the bottom surface 12B of the rotating actuator 12 and its three protruding pins 12S for securing the stand 20. FIG. 7 also illustrates the charging connector 19 and the cavities 13B for the screws 13A that fasten and hold the locks 13. FIG. 7 also illustrates the body 10 of the illuminator unit showing the receptacle 24 (only one of the three is shown) for locking the hooks 23 of the top cover 22, the cutout 7B for the placement of the LEDs 7A and the guide pins 22G for guiding the mounting of the PCB 6 and the top cover 22.

Figure 8:
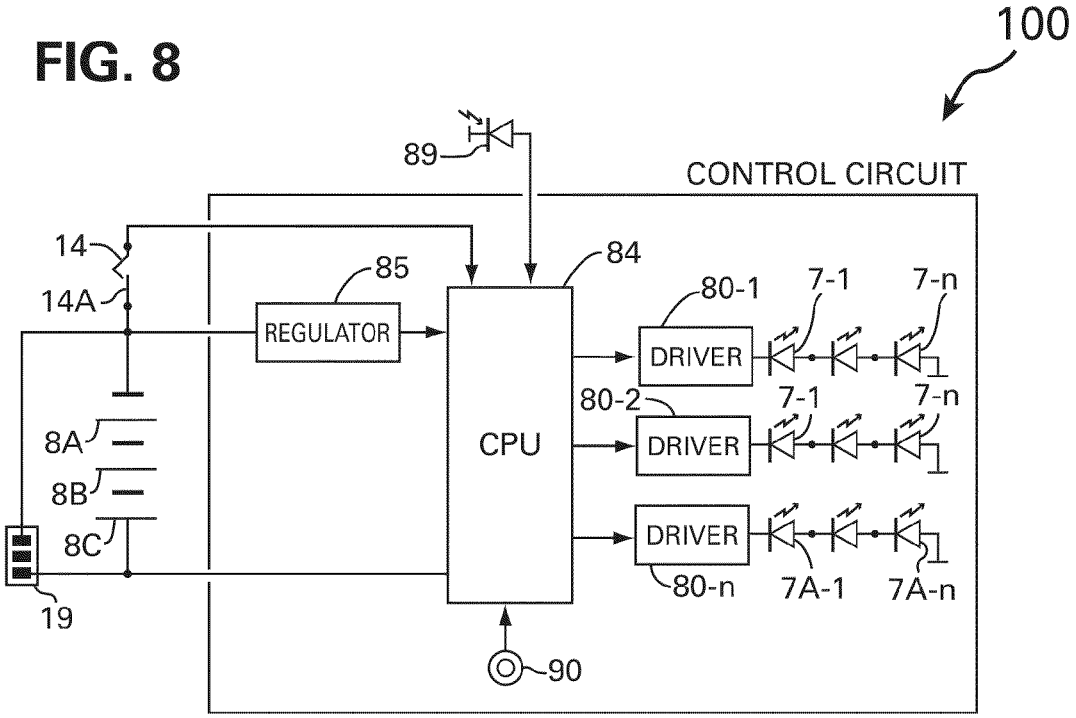
FIG. 8 is a block diagram of the power, control and illumination circuits of the preferred embodiment of the present invention.

FIG. 8 is a block diagram showing the electrical and control circuit 100 of the illuminator unit comprising the batteries 8A, 8B and 8C that feeds the power to the well known CPU (Central Processing Unit) 84 that is available in many versions at low cost in small IC packages. The battery power is fed via a voltage regulator 85 to ensure regulated feed. The CPU 84 feeds its control signals to n drivers 80-1~**80-*n* for driving the n LEDs 7 and n LEDs 7A. The LEDs are shown connected in series, but they can be fed and driven individually and/or in series and/or in parallel, with the regulator 85** may further include current regulator for powering the LEDs as programmed.

The programs for the illuminator can be a combination of programs, for example a program for increasing and decreasing in rotation the white illumination along with varying the orange colored lights to simulate candlelight. Other lighting programs such as a combination and variation in time duration, color variation, intensity variation, flashing programs, strobe programs, switching on and off time such as switching the illuminator in the evening and switching it off midnight.

The programs can be triggered and actuated serially by each pulse generated by the switch 14 connected to an input of the CPU 84 as explained above, or the programs can operate in automatic sequence mode and continuously. Similarly any other actuating device including the photo switches and/or the hall sensors explained above can be used. When plurality of switches and/or other actuating devices are used it is possible to select a given program on the basis of the rotating actuator 12 angle, whereby the angle of the rotated illuminator versus the rotating actuator position can be set to generate a selected command, such as a single control pulse from a given switching device, or plurality of control pulses simultaneously from a plurality of switching devices to several inputs of the CPU 84 (not shown), in accordance to a pre designed switching devices and activators layout.

Another shown command actuator is the IR receiver 89 for receiving remote control commands and for operating the illuminator and for actuating individually or serially or in parallel any of the above mentioned illumination programs. Instead of the IR receiver 89 shown, or in addition to the IR receiver shown, it is possible to include well known motion detector device (not shown) to operate the illuminator on the basis of for example, a motion evaluation programs. Further the shown IR receiver can be replaced by an RF receiver for receiving wireless remote control signals for activating the illuminator programs. Similarly a microphone can be included for activating the illumination programs based on the sound surrounding the illuminator and in accordance to a given sound programs, for example pink color in response to a woman voice and blue color in response to a male voice, on the basis of voice analysis.

The illumination, the remote control, the motion detection and the sound programs can be loaded to a CPU memory during the production or assembly of the circuit 100 but it can also be loaded and/or updated and/or modified and/or upgraded through the program input connector 90 at any given time. The battery charging connector 90 shown connected in parallel to the batteries 8A~8C can include a current regulator in its charging line to provide for example fast or slow charging, however such current control circuit can be included in the charger itself (not shown).

FIGS. 9A, 9B and 9C all show different mounts, holders and pendants for installing the illuminators with the icosahedron, i.e., the blank cover 40, the pre printed cover 61 and the example of a self imprinted cover 60, similar to the cover shown also in FIG. 1B. The mount 71 to install the illuminators on walls or other vertical structures fixedly can be modified by adding a chain to hang the illuminator on walls (not shown) the same way the illuminators are chained or fixedly attached to the ceiling mounts 72 and 73 of FIGS. 9B and 9C. The illuminators shown attached to a ceiling of FIGS. 9B and 9C can be installed under shelves and/or under any other similar horizontal surfaces.

Shown are only few examples of the unlimited variations possible, the wall holder 71 of FIG. 9A and the pendant or ceiling holder 72 of FIG. 9B illustrates the use of a plain pipe or solid round bar, but the bar can be of many shapes or design or color, bend to fit a décor, and/or colored to fit the different interiors and environment surrounding the illuminator. It can be an injected plastic or molded metal, it can be made of cut metal sheets, or an ornamentally made from wood or other materials. The decorative chain 73 of FIG. 9C also demonstrate the limitless design possibilities to hang the illuminator onto ceilings, shelf or walls and/or other horizontal or vertical objects using endless varieties of ropes, cables, wires, chains and the like.

Same apply to the stand or a support 20 shown in FIGS. 1A and 4A as a processed and bended metal sheet, but can be made of different materials, molded plastic, cast metal, decorating ceramic or similar decoration such as small vase or a plain small round plate or other shape for placement onto a table or other flat surfaces, or hanged as a pendant on a stand in endless colors, design and motifs.

It will of course, be understood by those skilled in the art that the particular embodiment of the invention here presented is by way of illustration only, and is meant to be in no way restrictive, therefore, numerous changes and modifications may be made, and the full use of equivalents resorted to, without departing from the spirit or scope of the inventions as outlined in the appended claims.

What is claimed is:

1. A method for attaching an incomplete polyhedron cover to an illuminator body, wherein said polyhedron cover includes plurality of attachment flaps and a base of said illuminator comprises corresponding slots for enclosing said flaps, at least one lock for locking said flaps to said base and an actuator accessible at about a center of the bottom of said base for installing a support, said method comprises the steps of:

a. assembling said polyhedron cover selected from one of a polyhedron structure short of at least one geometrical surface and a polyhedron structure with at least one truncated surface, wherein said surface is surrounded by said attachment flaps;

b. inserting said illuminator body into said polyhedron cover through said surface and said flaps into said slots;

c. tightening said at least one lock until said flaps lock to said base;

d. installing a support selected from a group comprising a stand for flat surfaces, a pendant, a ceiling mount, a wall mount and combinations thereof onto said actuator for enabling the rotation of said polyhedron cover about said support.

2. The method for attaching an incomplete polyhedron cover to an illuminator body according to claim 1, wherein said base further comprising at least one switching device and said actuator including at least one activator for operating said illuminator by feeding at least one actuating pulse from said switching device to a control circuit included in said illuminator, said method comprises the steps of:

e. engaging said activator with said switching device for actuating said illuminator by at least one action selected from a group comprising of rotating, positioning, pushing and pulling said polyhedron cover.

3. The method for attaching an incomplete polyhedron cover to an illuminator according to claim 2, wherein said actuator includes plurality of said activators and said illuminator includes plurality of said switching devices for engaging at least one of said switching devices selectively on the basis of the angle of said rotation position of said illuminator and said actuator for selectively generating actuating pulses commensurating with a given illuminator programs.

4. The method for attaching an incomplete polyhedron cover to an illuminator according to claim 2, wherein said illuminator further including at least one actuating circuit comprising an IR receiver, a wireless RF receiver, a motion detector, a microphone and combinations thereof, said method including the further step:

g. operating said illuminator by a command signal selected from a group comprising an IR remote control signal, an RF remote control signal, motion detected signal, motion analyzed signal, sound level signal, surrounding sound signal and combinations thereof.

5. The method for attaching an incomplete polyhedron cover to an illuminator according to claim 1, wherein said polyhedron cover is made of a precut sheet material selected from a group comprising paper, carton, plastic, polymer, acryl and combinations thereof and said precut comprises said geometrical surfaces including furrowed lines for folding said geometrical surfaces.

6. The method for attaching an incomplete polyhedron cover to an illuminator according to claim 5, wherein each of said precut geometrical surfaces is at least one of keyed and selectively pre applied with bond for attaching said geometrical surfaces to each other without error and for simplifying said assembly.

7. The method for attaching an incomplete polyhedron cover to an illuminator according to claim 5, wherein said sheet is imprinted by at least one of pre designed content and a custom designed content.

8. The method for attaching an incomplete polyhedron cover to an illuminator according to claim 5, wherein said sheet is of a standard paper size fit for printers.

9. The method for attaching an incomplete polyhedron cover to an illuminator according to claim 1, wherein said illuminator further including at least one actuating circuit comprising an IR receiver, a wireless RF receiver, a motion detector, a microphone and combinations thereof, said method including the further step:

f. operating said illuminator by a command signal selected from a group comprising an IR remote control signal, an RF remote control signal, motion detected signal, motion analyzed signal, sound level signal, surrounding sound signal and combinations thereof.

10. A combination of an incomplete polyhedron cover and an illuminator body, wherein said polyhedron cover includes plurality of attachment flaps and a base of said illuminator comprises corresponding slots for enclosing said flaps, at least one lock for locking said flaps to said base and an actuator accessible at about a center of the bottom of said base for installing a support;

said polyhedron cover selected from one of a polyhedron structure short of at least one geometrical surface and a polyhedron structure with at least one truncated surface, wherein said surface is surrounded by said attachment flaps for inserting said illuminator body into said polyhedron cover through said surface and said flaps into said slots;

said polyhedron cover is firmly locked to said base by tightening said at least one lock onto said flaps and said support selected from a group comprising a stand for flat surfaces, a pendant, a ceiling mount, a wall mount and combinations thereof is installed onto said actuator enabling the rotation of said polyhedron cover around said support.

11. The combination of an incomplete polyhedron cover and an illuminator body according to claim 10, wherein said base further comprising at least one switching device and said actuator including at least one activator for operating said illuminator by feeding at least one actuating pulse from said switching device to a control circuit included in said illuminator by engaging said activator with said switching device through an action selected from a group comprising of rotating, positioning, pushing and pulling said polyhedron cover.

12. The combination of an incomplete polyhedron cover and an illuminator according to claim 11, wherein said actuator includes plurality of said activators and said illuminator includes plurality of said switching devices for engaging at least one of said switching devices selectively on the basis of the angle of said rotation position of said illuminator and said actuator for selectively generating actuating pulses commensurating with a given illuminator programs.

13. The combination of an incomplete polyhedron cover and an illuminator according to claim 11, wherein said illuminator further including at least one actuating circuit comprising an IR receiver, an RF wireless receiver, a motion detector, a microphone and combinations thereof for operating said illuminator by a command signal selected from a group comprising an IR remote control signal, an RF remote control signal, motion detected signal, motion analyzed signal, sound level signal, surrounding sound signal and combinations thereof.

14. The combination of an incomplete polyhedron cover and an illuminator according to claim 11, wherein said control circuit comprising a well known central processor with light control programs connected to at least one LED via one of direct and through at least one buffer for controlling the current flow to said LED, said central processor including at least one input port to receive actuating signals for operating said illuminator on the basis of said light control program comprising switch on, switch off, switch on and off at selected time, select color, switch over color, change colors gradually, simulate candle light, partition the light color, flash, strobe and combinations thereof.

15. The combination of an incomplete polyhedron cover and an illuminator according to claim 10, wherein said polyhedron cover is made of a precut sheet material selected from a group comprising paper, carton, plastic, polymer, acryl and combinations thereof and said precut comprises said geometrical surfaces including furrowed lines for folding said geometrical surfaces.

16. The combination of an incomplete polyhedron cover and an illuminator according to claim 15, wherein each of said precut geometrical surfaces is at least one of keyed and selectively pre applied with bond for attaching said geometrical surfaces to each other without error and for simplifying said assembly.

17. The combination of an incomplete polyhedron cover and an illuminator according to claim 15, wherein said sheet is imprinted by at least one of pre designed content and a custom designed content.

18. The combination of an incomplete polyhedron cover and an illuminator according to claim 15, wherein said sheet is of a standard paper size fit for printers.

19. The combination of an incomplete polyhedron cover and an illuminator according to claim 15, wherein the angle of said precut geometrical surfaces are individually oriented for enabling the alignment of the design and the printout of said cut sheet.

20. The combination of an incomplete polyhedron cover and an illuminator according to claim 10, wherein said illuminator further including at least one actuating circuit comprising an IR receiver, an RF wireless receiver, a motion detector, a microphone and combinations thereof for operating said illuminator by a command signal selected from a group comprising an IR remote control signal, an RF remote control signal, motion detected signal, motion analyzed signal, sound level signal, surrounding sound signal and combinations thereof.

21. The combination of an incomplete polyhedron cover and an illuminator according to claim 10, wherein the top end of said illuminator body supports a top inner area of said polyhedron cover.

22. The combination of an incomplete polyhedron cover and an illuminator according to claim 10, wherein said illuminator including plurality of LEDs powered by at least one battery selected from one of a replaceable battery and a rechargeable battery and wherein at least one of a connector, a slip ring and an induction device is included in said base for recharging said rechargeable battery.

23. The combination of an incomplete polyhedron cover and an illuminator according to claim 10, wherein said control circuit comprising a well known central processor with light control programs connected to at least one LED via one of direct and through at least one buffer for controlling the current flow to said LED, said central processor including at least one input port to receive actuating signals for operating said illuminator on the basis of said light control program comprising switch on, switch off, switch on and off at selected time, select color, switch over color, change colors gradually, simulate candle light, partition the light color, flash, strobe and combinations thereof.

* * * * *